US005896861A

United States Patent [19]

Veluz

[11] Patent Number: 5,896,861

[45] Date of Patent: Apr. 27, 1999

[54] PROCESS FOR AROMATIZING AND/OR FILTERING TOBACCO SMOKE, CIGARETTE END PIECE FOR CARRYING OUT THE PROCESS AND USE OF THIS PROCESS

[75] Inventor: Serge Veluz, Cuarnens, Switzerland

[73] Assignee: Baumgartner Papier S.A., Crissier, Switzerland

[21] Appl. No.: 08/575,773

[22] Filed: Dec. 20, 1995

[30] Foreign Application Priority Data

Dec. 23, 1994 [CH] Switzerland ..... 3 910/94

[51] Int. Cl.[6] ..... A24D 3/04

[52] U.S. Cl. ..... 131/342; 131/335

[58] Field of Search ..... 131/342, 335

[56] References Cited

U.S. PATENT DOCUMENTS

| | | | |
|---|---|---|---|
| 3,353,543 | 11/1967 | Sproull | 131/342 |
| 3,354,886 | 11/1967 | Berger et al. | 131/342 |
| 3,658,069 | 4/1972 | Wise et al. | 131/342 |
| 4,038,992 | 8/1977 | Ogasa et al. | 131/342 |
| 4,062,368 | 12/1977 | Crellin et al. | 131/342 X |
| 4,662,384 | 5/1987 | Green | 131/342 X |
| 5,083,579 | 1/1992 | Vanin et al. | 131/342 X |

FOREIGN PATENT DOCUMENTS

| | | |
|---|---|---|
| A-673976 | 4/1966 | Belgium . |
| B-2636316 | 12/1977 | Germany . |
| A-488413 | 5/1970 | Switzerland . |
| A-2122473 | 1/1984 | United Kingdom . |
| SE93/01085 | 7/1994 | WIPO . |

*Primary Examiner*—John G. Weiss
*Assistant Examiner*—Charles W. Anderson
*Attorney, Agent, or Firm*—Hazel & Thomas, P.C.

[57] ABSTRACT

The process serves to more precisely aromatize and/or remove certain smoke fume constituents from tobacco smoke or tobacco smoke drawn from a cigarette, by means of a flowable carrier material or filtration material for aromatizing products, arranged in a cavity (1) of a mouthpiece of the cigarette.

For this purpose, the flowable active carrier material or filter material (2) for aromatizing products is, before being put into this cavity (1), mixed with at least one flowable material (3) which is inactive with respect to tobacco smoke flowing through to give a mixture which is as homogeneous as possible, and, mixed in this way, is introduced into the cavity (1).

16 Claims, 1 Drawing Sheet

PROCESS FOR AROMATIZING AND/OR FILTERING TOBACCO SMOKE, CIGARETTE END PIECE FOR CARRYING OUT THE PROCESS AND USE OF THIS PROCESS

BACKGROUND OF THE INVENTION

1. Field of the Invention

The invention relates to a process for aromatizing and/or removing certain smoke fume constituents from tobacco smoke or tobacco smoke drawn from a cigarette. The process is carried out by means of a flowable carrier material or filtration material for aromatizing products, which is arranged in a cavity of a mouthpiece of the cigarette, wherein the flowable active carrier material or filter material for aromatizing products is, before being put into this cavity mixed with at least one flowable material which is inactive with respect to tobacco smoke flowing through to give a mixture which is as homogeneous as possible, and, mixed in this way, is introduced into the cavities. The invention further relates to a cigarette end piece, in particular a cigarette filter, for carrying the process and to a use of this process.

2. Description of the Prior Art

It is already known that the cavities of so-called cavity filters can be partially filled with the greatest variety of flowable carrier material and/or filter material for aromatizing products, since in the case of certain tobacco types completely filling these cavities with these granular materials would have too great an influence and thus a negative influence, on the tobacco smoke flowing through these cavities and, moreover, would also be too expensive. If, however, a filter cavity is filled for example only to 5% of its volume with an active material of this type, then, observed over the entire flow cross-section of the flow of smoke fumes that the smoker draws into his mouth, only a quite narrow, small segment of the flow of smoke fumes is aromatized or filtered, and in some cases this occurs in a different manner each time the smoker draws on a cigarette of this type, which is extremely undesirable as regards the sense of taste of a smoker.

Furthermore, cavities which are only partially filled with flowable active material have the effect that the cigarette filters provided therewith a risk of collapsing on further processing (that is to say when they are transported and connected to the tobacco part to form the filter cigarettes) when used in certain further processing plants because of the insufficient stabilities of these partially filled cavities, and this can give rise to unpleasant disruptions in the further processing of cigarette filters of this type. Furthermore, cigarette filters having cavities only partially filled with flowable or permeable active material have the further disadvantage that, on flowing through these only partially filled cavities, the tobacco smoke follows the path of least flow resistance, that is to say it flows through the unfilled part of a cavity of this type instead of through the granular active material, as a result of which is the achieving of optimum exploitation of the activity not being possible.

SUMMARY OF THE INVENTION

The object of the present invention is primarily to provide a process which does not have the above-listed disadvantages of previous processes, that is to say, which enables very precise adjustment of the degree of aromatization and/or filtration of tobacco smoke flowing through a cigarette. A further object of the invention is provide an extremely stable cavity which does not risk collapsing, and brings about optimum flow-through and exploitation of the granular active material located in a cavity of a cigarette end piece.

In accordance with a first embodiment of the present invention, this object is achieved by means of a flowable carrier material or filtration material for aromatizing products, which is arranged in a cavity of a mouthpiece of the cigarette, wherein the flowable active carrier material or filter material for aromatizing products is, before being put into this cavity, mixed with at least one flowable material which is inactive with respect to tobacco smoke flowing through to give a mixture which is as homogeneous as possible, and, mixed in this way, is introduced into the cavities.

The process further comprises filling the cavity of the mouthpiece at least approximately completely, preferably at least to 95%, with the mixture of flowable or permeable activated charcoal and inactive wood charcoal.

A further embodiment of the present invention includes mixing the flowable active carrier material or filtration material for aromatizing products by volume, before being put into this cavity, with at least the same volume quantity of the flowable material which is inactive with respect to the tobacco smoke flowing through.

The process is further characterized by adjusting the activity of aromatization or adsorption of the corresponding carrier material or filtration material, such as activated charcoal to the degree of aromatization or filtration which is subsequently desired, by mixing it with a flowable material, such as inactive wood charcoal which is inactive with respect to tobacco smoke flowing through in a certain mixing ratio, and the cavity of the cigarette end piece is at least approximately completely filled, and preferably to at least 95% to 97%, with the active carrier material or filtration mixture.

A further embodiment of the process is characterized by, at least partially, using flowable silica gel as the active carrier material or filtration material.

Another embodiment of the present invention is characterized by, at least partially, using flowable magnesium silicate as the active carrier material and filtration material.

A further embodiment of the invention involves using, at least partially, flowable activated charcoal as the filtration material.

Another embodiment of the present invention is characterized by using inactive charcoal, for example inactive wood charcoal, whereof the granule size is preferably in the range from 0.2 to 1.5 mm diameter, as the flowable or material which is inactive with respect to tobacco smoke flowing through.

Further embodiments of the present invention are characterized by the inactive flowable material having at least approximately the same density and particle size as the active flowable carrier material or filtration material.

The invention furthermore relates to a cigarette end piece for carrying out the process of the present invention, wherein said cigarette end piece has a cavity containing a homogeneous mixture of at least an active carrier material charged with aromatizing products and/or an active filtration material, such as activated charcoal, and a flowable filling materials, such as inactivated wood charcoal, which is inactive with respect to the tobacco smoke flowing through the cigarette end piece. Convenient further embodiments of the cigarette end piece according to the invention include filling the cavity, at least approximately completely and preferably to at least 95%, with the mixture of activated charcoal and inactivated wood charcoal.

The invention moreover relates to the use of the process according to the invention for the purpose of controlling the aromatization and/or filtration of the tobacco smoke.

BRIEF DESCRIPTION OF THE DRAWING

The invention is explained in more detail below by way of example, with reference to the drawing.

DETAILED DESCRIPTION OF THE PREFERRED EMBODIMENT

Figure 1:
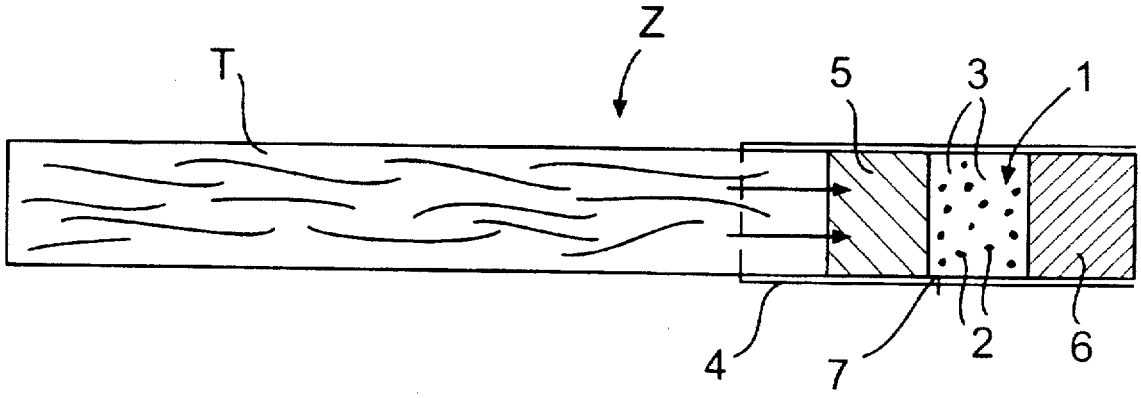
FIG. 1 is an enlarged view of a cigarette and filter in accordance with a preferred embodiment of the present invention.

As can be seen from the drawing, a cigarette Z (illustrated on an enlarged scale for better clarity of view) is provided with a tobacco part T which is connected, by way of a so-called tipping paper strip 4, to a cavity filter. The cavity filter comprises the two plugs 5 and 6, which are connected to a wrapping strip 7 in a known manner, to form a cavity 1 located between them.

When the cavity filters are manufactured, first of all, taking as a basis the desired activity of aromatization and/or filtration of the active material granules 2 to be put into a cavity 1, the quantity thereof (for example of flowable activated charcoal) and the quantity required to virtually completely fill the corresponding cavity 1, of flowable filling material which is inactive in tobacco smoke flowing past (for example inactive wood charcoal 3 or particles), and thus the mixing ratio required are determined.

Thereupon, this flowable granule mixture to be put into these filter cavities can be manufactured simply and very precisely in this previously determined mixing ratio of activated charcoal 2 and inactive wood charcoal 3, with an extremely uniform distribution of the two mixing components with one another, and can for example be introduced into the cavities 4 of a cigarette filter unit to be manufactured by means of a device known from Swiss reference number CH-A-604 574.

With the cavities 1 completely filled with this mixture, the quantity of flowable activated charcoal 2 located in these cavities 1 is consequently extremely precise, with the result that in this way no significant difference in the quantity 2 of active material put in or in the activity of filtration can be perceived between the different cavities 1.

In this way, even relatively small quantities of flowable activated charcoal, taking up for example only 20% of the cavity volume, are arranged and distributed extremely uniformly over the entire cavity volume and supported in the filling material 3 comprising inactive flowable charcoal. Consequently, the risk of a cavity 1 that filled in this manner, and consequently supported on the inside by the flowable granule material which has been put in, collapsing during further processing of the cigarette filter units manufactured in this way is removed.

As a result of the extremely uniform distribution of the activated charcoal constituents 2 which is obtained in this way over the entire volume of the cavity, an extremely uniform flow against all the activated charcoal constituents 2 located in this cavity 1 and thus in turn optimum exploitation of the adsorption activity thereof on the tobacco smoke flowing through are also achieved.

To achieve properties of aromatization and filtration which are as similar as possible, the best possible filling of the individual cavities 1 with the mixture of flowable or permeable material 2, 3 which is active and inactive with respect to the tobacco smoke flowing through should be sought after between different cigarette filter units, although in practice, depending on the system used for depositing this mixture into the individual cavities 1, a maximum degree of filling the cavity of only about 95 to 97% of the cavity volume is achievable, but by comparison with previously known processes using a substantially smaller volume of active material per cavity than the cavity volume this still brings about quite substantial advantages.

While the invention has been described in conjunction with one of its preferred embodiments, it should be understood that changes and modifications may be made without departing from the scope and spirit of the appended claims.

I claim:

1. A process for forming a cigarette mouth piece for aromatizing and/or removing selected smoke fume constituents from tobacco smoke drawn from the cigarette, said process comprising the steps of:

evaluating the quantity of flowable carrier material charged with aromatic substances and/or flowable filtration material as active material which is necessary to achieve a desired activity of armoatization respective to a desired degree of filtration in a cavity or a mouth piece of a cigarette and to arrive at a mixing ratio of the active flowable material to material which is inactive with respect to tobacco smoke flowing therethrough;

providing a flowable carrier material charged with aromatic substances and/or a flowable filtration material as the active material;

mixing said active material with at least one flowable material as the inactive material to form a substantially homogeneous mixture; and, positioning said homogeneous mixture in the cavity of the mouth piece of a cigarette, wherein said step of positioning said homogeneous mixture in the cavity of the mouthpiece includes filling the cavity to at least to 95% capacity with said mixture.

2. A process as claimed in claim 1, wherein a quantity by volume of the active material is mixed with a quantity of the inactive material of at least the same volume.

3. A process as claimed in claim 1, wherein the activity of aromatization or adsorption of the corresponding carrier material or filtration material is adjusted to a desired degree of aromatization or filtration by mixing at least one of the carrier material and filtration material with the flowable material in a predetermined mixing ratio, and wherein said step of positioning the mixture in the cavity of the mouthpiece includes substantially filling the cavity with this mixture.

4. A process as claimed in claim 1, wherein the active material comprises flowable silica gel.

5. A process as claimed in claim 1, wherein the active material comprises flowable magnesium silicate.

6. A process as claimed in claim 1, wherein the inactive material comprises flowable inactive charcoal.

7. A process as claimed in claim 1, wherein the inactive material comprises inactive charcoal with a granule size in the range of from 0.2 to 1.5 mm in diameter.

8. A process as claimed in claim 1, wherein the active flowable material and the inactive flowable material have approximately the same density.

9. A process as claimed in claim 1, wherein the active flowable material and the inactive flowable material have approximately the same particle size.

10. A cigarette mouthpiece used for aromatizing and/or removing selected smoke fume constituents from tobacco smoke drawn from the cigarette, said mouthpiece having a cavity filled to at least 95% capacity with a substantially homogeneous mixture of an active material which contains a flowable carrier material, a flowable filtration material, or a combination thereof, and at least one flowable material that is inactive with respect to tobacco smoke flowing therethrough.

11. The cigarette mouthpiece as claimed in claim 10 wherein the active material comprises silica gel.

12. The cigarette mouthpiece as claimed in claim 10 wherein the active material comprises magnesium silicate.

13. The cigarette mouthpiece as claimed in claim 10 wherein the inactive material comprises inactive charcoal with a granule size in the range of from 0.2 to 1.5 mm in diameter.

14. The cigarette mouthpiece as claimed in claim 10 wherein the active flowable material and the inactive flowable material have approximately the same density.

15. The cigarette end piece as claimed in claim 10 wherein the active flowable material and the inactive flowable material have approximately the same particle size.

16. The cigarette end piece as claimed in claim 10 wherein the active material comprises magnesium silicate, the inactive material comprises inactive charcoal with a granule size in the range of from 0.2 to 1.5 mm in diameter, and the active material and the inactive material have approximately the same density and particle size.

* * * * *